United States Patent [19]

Nagamoto

[11] 4,203,596

[45] May 20, 1980

[54] RACKET AND A METHOD FOR MANUFACTURING SAME

[75] Inventor: Itsushi Nagamoto, Hamamatsu, Japan

[73] Assignee: Nippon Gakki Seizo Kabushiki Kaisha, Japan

[21] Appl. No.: 847,717

[22] Filed: Nov. 2, 1977

[30] Foreign Application Priority Data

Nov. 4, 1976 [JP] Japan ..... 51-148381

[51] Int. Cl.[2] ..... A63B 49/04

[52] U.S. Cl. ..... 273/73 J; 273/73 F

[58] Field of Search ..... 273/67 R, 67 D, 67 DA, 273/73 R, 73 C, 73 F, 73 H, 73 J, 73 K, 75, 81 R, 81 A, 82 R, 82 A, DIG. 7, 23; 280/610

[56] References Cited

U.S. PATENT DOCUMENTS

| | | | |
|---|---|---|---|
| 2,064,435 | 12/1936 | Loeffler | 273/82 A X |
| 2,166,950 | 7/1939 | German et al. | 273/82 A |
| 3,635,482 | 1/1972 | Holman | 273/73 F X |
| 3,844,576 | 10/1974 | Schultes | 280/610 |

FOREIGN PATENT DOCUMENTS

| | | | |
|---|---|---|---|
| 162109 | 3/1955 | Australia | 273/73 K |
| 323770 | 1/1930 | United Kingdom | 273/73 J |
| 498430 | 1/1939 | United Kingdom | 273/73 D |
| 803782 | 10/1958 | United Kingdom | 273/67 DA |
| 1362116 | 7/1974 | United Kingdom | 273/73 F |
| 1436755 | 5/1976 | United Kingdom | 273/73 F |

*Primary Examiner*—Richard J. Apley

*Attorney, Agent, or Firm*—Lerner, David, Littenberg & Samuel

[57] ABSTRACT

A racket advantageously usable for tennis has a racket frame grip portion in which one or more weight elements made of a relatively heavy material are fully embedded for successful betterment of the entire weight distribution, i.e. the head-to-handle weight balance, suited for the "light" racket. The weight elements are of a metallic material, such as iron, lead, or tungsten, and the material has a specific gravity which is equal to or greater than the specific gravity of iron.

Manufacture can be carried out by the simple molding process well suited for mass-production.

15 Claims, 6 Drawing Figures

RACKET AND A METHOD FOR MANUFACTURING SAME

BACKGROUND OF THE INVENTION

The present invention relates to an improved racket and a method for manufacturing same, and more particularly relates to improvement in the head-to-handle weight balance construction of a fiber reinforced plastic racket by molding process and advantageously usable for tennis.

In general, handling and playing characteristics of any racket are mainly related to, and affected by the strength of a player, especially gripping force of the player, the total weight of the racket and the weight distribution of the racket. In addition, influences by these factors vary from player to player in accordance with personal preferences. Among the factors, the manner in which the weight is distributed has a very definite bearing on the accuracy attainable on a given stroke and on the power or force of that stroke. Further, the weight distribution, i.e. the head-to-handle weight balance, determines the maneuverability of the racket, i.e. the speed with which the racket may be brought into position for striking balls.

In tennis parlance, a "light" racket is one in which the center of gravity is relatively closer to the grip portion of the racket, while a "heavy" racket is one in which the center of gravity is relatively closer to the head portion of the racket. A "light" racket is the more maneuverable of the two, that is, it can be brought into position more quickly to make the stroke.

With recent general trend of tennis players towards the so-called "speedy tennis", there is an increasing demand for the "light" racket which, assures high maneuverability, i.e. quick stroking. In addition, as described already, the influence on the racket maneuverability by the weight distribution greatly varies from player to player. In order to meet thus varying personal preferences of the players, it is desirable that the weight distribution of rackets may be stepwise adjusted from lot to lot of the rackets.

In the conventional manufacturing of a fiber reinforced plastic racket, an elongated core made of a foamed resin is wholly, wrapped and covered by an elongated "prepreg" envelope made of numerous reinforcing fiber preimpregnated with a thermosetting resin to prepare an elongated rod which then is curved and set in position in a mold. The resin is then hardened by application of heat under pressure to obtain a fiber reinforced plastic racket. This molding process is well suited for the mass-production now in fashion in every field of the industry. However, such a mass-production type molding process affords very little possibility in adjusting the weight distribution of the rackets in the above-described sense.

Thus, adjustment of the racket weight distribution is conventionally and generally dependent upon personal efforts of players using the racket. In one instance, a tape or tapes are wound around the grip portion of the racket in order to obtain firm grip on the racket. Although this measure may be effective in adjustment of the "grip" on the racket, it cannot sufficiently adjust the weight distribution of the racket due to the relatively light nature of the tape. Tape winding suited for ideal grip on racket by a player does not always bring about ideal weight distrubution suited for the personal preference of the player. Likewise, tape winding suited for ideal weight distribution for a player does not always assure ideal grip on racket by the player.

In the other instance, a sharp, weighted, metallic plug is inserted into the core of the racket grip portion from the butt end, thereby displacing the center of gravity of the racket towards the grip portion. Although this plug may adjust the weight distribution, i.e. the head-to-handle balance, of the racket, forced insertion of the plug into the foamed resin core tends to develop undesirable cracks in the core. In addition, long use of the racket having such a plug may cause shearing destruction of the foamed resin configuration embracing the inserted plug due to the bending stress and impact loading repeatedly acting on the racket. Such configurational destruction of the foamed resin core leads to loosening in support for the plug and generation of noises jar upon the ear at striking balls.

SUMMARY OF THE INVENTION

It is one object of the present invention to provide a racket having an ideal weight balance construction ideally suited for quick stroke as a "light" racket.

It is the other object of the present invention to provide a racket having a weight balance construction allowing delicate adjustment of the racket's playing response in accordance with personal preferences.

It is a further object of the present invention to provide a racket having a novel weight balance construction excellently durable against long use even under crucial conditions.

It is yet a further object of the present invention to provide a novel method for manufacturing a racket having the above-described excellent functional features by a simple plastic molding process well suited for mass-production.

In accordance with the present invention, one or more weight elements preferably made of a relatively heavy material such as metal are fully embedded in the fiber reinforced plastic racket frame in the grip portion. The weight element in general takes the form of an elongated, flat, thin plate which is advantageously provided with a corrugated or perforated or rugged surface construction. In the manufacturing, the weight element or elements are set in the mold together with the material rod including a prepreg envelope made of numerous fibers preimpregnated with a thermosetting resin. During hardening of the resin by application of heat under pressure, the weight elements are firmly anchored to and embraced by the fiber reinforced plastic configuration of the racket frame in the grip portion.

DESCRIPTION OF THE PREFERRED EMBODIMENT

Figure 1:
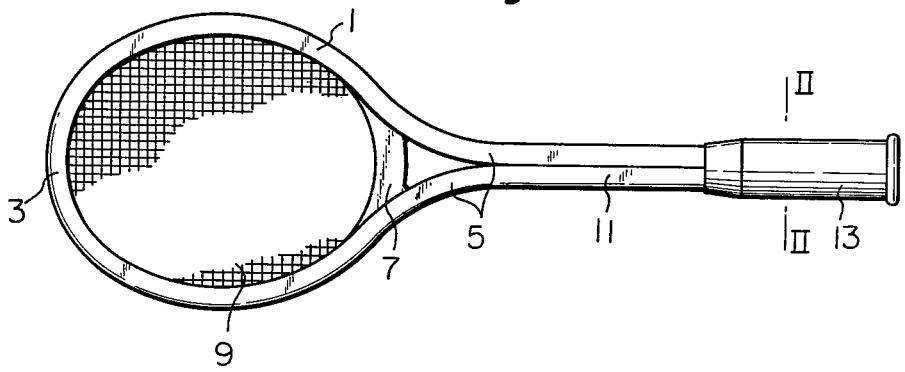
FIG. 1 is a top view of a popular type tennis racket to which the present invention is advantageously applicable.

FIG. 1 generally depicts a tennis racket of a popular type and construction made of fiber reinforced plastics to which the present invention is advantageously applicable.

The racket comprises a frame 1 having an approximately oval-shaped or ovaloid head portion 3 terminating in a pair of closely spaced sloping extensions forming a throat portion 5 of the racket. A separate throat piece or yoke 7 is disposed to the inner sides of the sloping frame extensions at the throat portion 5. The oval-shaped portion of the frame 1 and the yoke 7 defines a striking area of playing face 9 of the racket which is comprises of main or long strings and cross or short strings, both being in tightly stretched state. The sloping frame extensions are coupled side by side in one body with each other to form a handle or shaft portion 11 of the racket, the end of which is encased by a grip portion 13.

Figure 3:
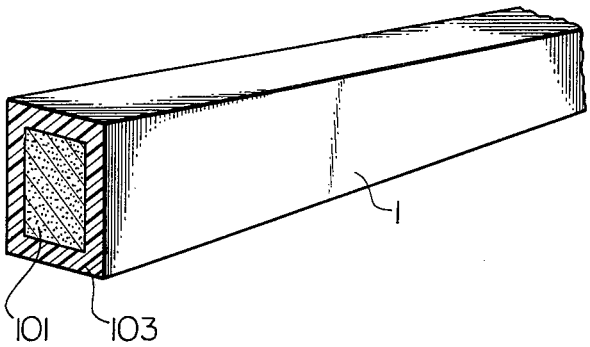
FIG. 3 is a fragmentary perspective view, partly in section, of the racket frame used for the racket shown in FIG. 1.

As later described in more detail, the racket frame 1 is made of fiber reinforced plastics by molding process. One example of the internal construction of the racket frame 1 is shown in FIG. 3, in which an elongated core 101 generally made of a foamed resin such as urethane foam is wholly covered by an elongated envelope 103 made of numerous fibers such as glass fibers combined with set theremosetting resin. In the other example, the racket frame 1 has a coreless construction. That is, the core 101 used in the example shown in FIG. 3 is omitted and the racket frame 1 is made of the fiber reinforced plastic envelope 103 only. The present invention is applicable to racket frames of either type.

According to the present invention, one or more weight elements are embedded into the racket frame 1 in the grip portion 13. As already described, the sloping extensions of the racket frame 1 are coupled side by side in one body with each other in the shaft and grip portions 11 and 13 and the weight element of elements are embedded into this coupled construction. The weight element generally takes the form of an elongated flat, thin plate and is generally rectangular in shape. A relatively heavy metallic material such as iron, lead and tungsten is advantageously used for the weight element.

Figure 2A:
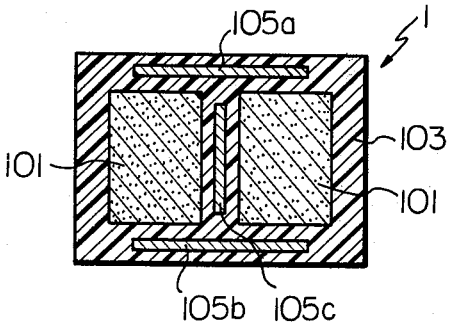
FIGS. 2A and 2B are examples of cross sections of the racket in accordance with the present invention taken along the line II—II in FIG. 1.

One embodiment of the present invention is shown in FIG. 2A, in which, in the grip portion 13, two separate weight elements **105*a* and 105*b* are fully embedded in the racket frame envelope 103 on both sides of the racket frame cores 101 while extending longitudinally of the grip portion 13, the width direction thereof being substantially parallel to the playing face 9 (see FIG. 1) of the racket. An additional weight element 105*c* is fully embedded also in the racket frame envelope 103 at a position between the two racket frame cores 101 while extending longitudinally of the grip portion 13, the width direction thereof being substantially normal to the playing face 9** of the racket.

In one modification of the illustrated embodiment, one or two of the above-described three weight elements **105*a* to 105*c* may be omitted in accordance with the actual condition under which the racket is to be used. In the other modification of the illustrated embodiment, at least one of the two weight elements 105*a* and 105*b* may be positioned on the outer side of one of the core 101 substantially in parallel to the center weight element 105*c*. However, from the viewpoint of providing appreciable tenacity and flexibility to the racket against impact to be imposed on the playing face 9** at striking balls, it is advantageous that at least one weight element should exist in a plane parallel to the playing face of the racket.

Figure 2B:
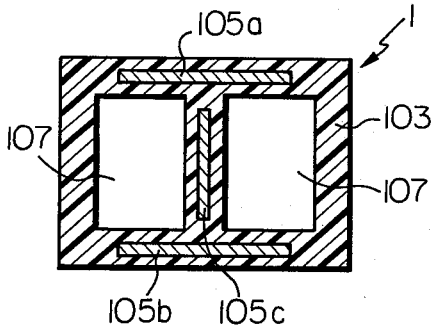

The other embodiment of the present invention is shown in FIG. 2B, in which the weight elements **105*a* to 105*c* are embedded in the grip portion 13 of the above-described coreless construction. In this case, the two separate weight elements 105*a* and 105*b* are fully embedded in the racket frame envelope 103 on both sides of elongated bores 107 while extending longitudinally of the grip portion 13, the width direction thereof being substantially parallel to the playing face 9 of the racket. The additional weight element 105*c* is fully embedded also in the racket frame envelope 103 at a position between the two bores 107 while extending longitudinally of the grip portion 13, the width direction thereof being substantially normal to the playing face 9** of the racket.

Figure 5:
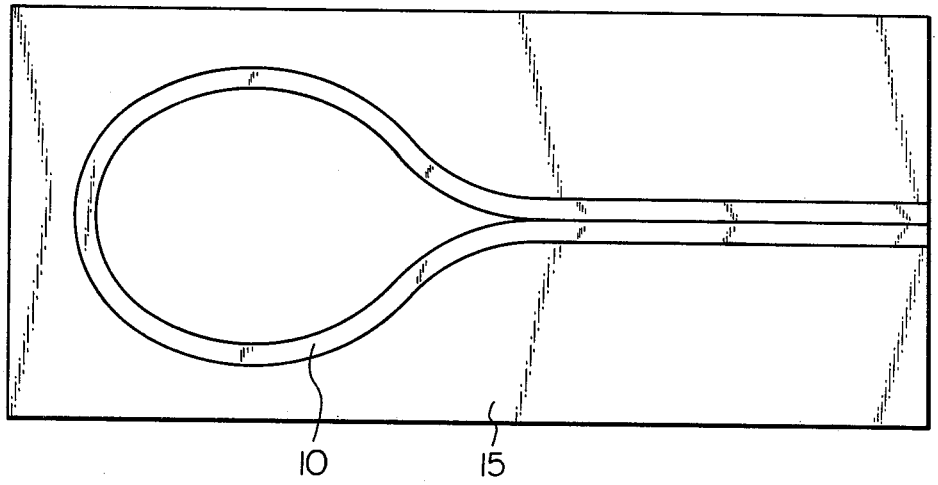
FIG. 5 is a top view of a mold used for shaping the racket in accordance with the present invention with the material rod in position.
Figure 4:
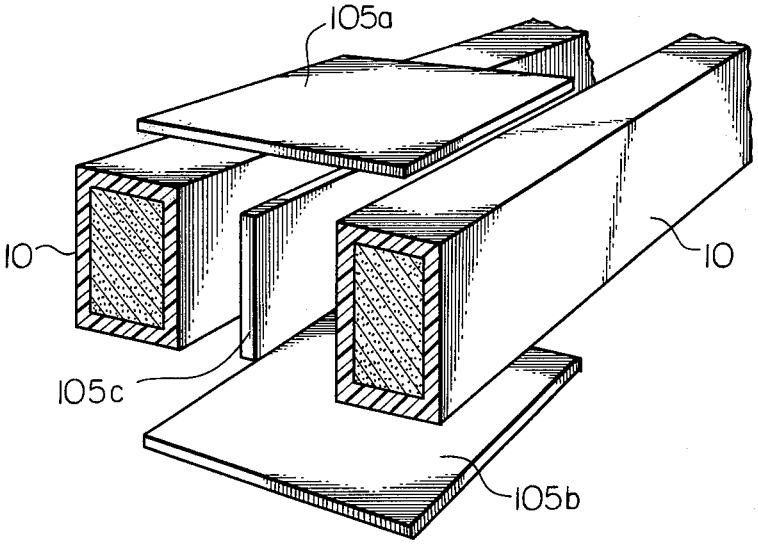
FIG. 4 is an explanatory perspective view, partly in section, for showing how to couple the weight elements to the material rod in the manufacturing process in accordance with the present invention.

In the manufacturing of the racket in accordance with the present invention, a core is wholly wrapped and covered by a prepreg envelope made of numerous reinforcing fibers preinpregnated with thermosetting resin to form a straight rod. This straight material rod 10 is then curved and placed in position between cooperating molds 15, one of which is shown in FIG. 5. Concurrently with this, the weight elements **105*a* to 105*c* are set in position retative to the material rod 10 in the mold 15 as shown schematically in FIG. 4**. Then, heat is applied to the molds under pressure for hardening of the resin component to the end product.

In the construction of the end product, the weight elements are fully embedded in one body in the racket frame envelope 103 of the grip portion.

Elongated flat, thin plate are used for the weight elements in the foregoing embodiments. In a preferred embodiment of the present invention, the weight element may be provided with a corrugated or perforated or rugged surface construction. Uneven surface construction of the weight element results in fortified anchoring of the weight element to the resin envelope covering same and, thereby, assures highly durable bonding between the weight element and the racket frame envelope.

The weight element or elements should be positioned in the grip portion of the racket. The center weight element **105*c*** is positioned just along the center axis of the racket and, hence, contributes to stable total balance of the racket.

It was experimentarily confirmed by the inventor of the present invention that the total percent weight of the weight element in a racket without strings should advantageously be in a range from 2 to 20%.

In some actual examples of the tennis racket to which the present invention is applied, the total weight of the racket without strings is in a range from 360 to 370 g. while the total weight of the weight element is in a range from 20 to 30 g. In one example, the weight element is 16 mm. in width, 80 mm. in length and 28 g. in weight.

In accordance with the present invention, the weight element or elements are fully embedded in the racket frame envelope in the grip portion of the racket. Use of the weight element(s) assures ideal weight balance of the racket, thereby successfully matching the racket's playing performance with quick stroke as a "light" racket. In other words, maneuverability of the racket can be greatly enhanced. Tactful adjustment of the distribution, total weight and number of the weight element(s) at manufacture results in delicate matching of the racket's playing response with various personal preferences. In addition, the fully embedded construction of the weight element(s) leads to high durability of the racket even after long use. Further, in accordance with the present invention, rackets having the above-described excellent functional features can be manufactured by a simple plastic molding process which is well suited for massproduction.

I claim:

1. An improved racket comprising a racket frame including a striking section and a handle section, said handle section including an elongated envelope made of fiber reinforced plastics, at least one or more weight elements substantially fully embedded in said envelope in only the grip portion of said handle section, said weight elements being of metallic material having a specific gravity being equal to or greater than the specific gravity of iron.

2. An improved racket as claimed in claim 1 in which said racket frame further includes a core made of a foamed resin and wrapped and covered by said envelope.

3. An improved racket as claimed in claim 1 in which at least one of said weight elements extends in a plane substantially parallel to the playing face of said racket.

4. An improved racket as claimed in claim 1 in which at least one of said weight elements extends in a plane substantially normal to the playing face of said racket.

5. An improved racket as claimed in claim 4 in which said at least one weight element extends substantially along the longitudinal center axis of said racket.

6. An improved racket as claimed in claim 1 in which said weight elements take the form of an elongated, flat, thin plate.

7. An improved racket as claimed in claim 6 in which said weight elements are substantially rectangular in shape.

8. An improved racket as claimed in claim 6 in which said weight elements are provided with an uneven surface.

9. An improved racket as claimed in claim 8 in which said uneven surface has a corrugated construction.

10. An improved racket as claimed in claim 8 in which said uneven surface has a perforated construction.

11. An improved racket as claimed in claim 8 in which said uneven surface has a rugged construction.

12. An improved racket as claimed in claim 1 in which said weight elements are made of iron, lead, or tungsten.

13. An improved racket as claimed in claim 1 in which the total percent weight of said weight element in said racket frame without strings is in a range from 2 to 20.

14. A method for manufacturing a racket comprising preparing a frame including an elongated prepreg envelope made of numerous reinforcing fibers preimpregnated with a thermosetting resin, setting said frame in position in a mold while curing the former, concurrently attaching one or more weight elements to said frame in said mold only in a portion to be formed into the grip portion in the end product, and hardening said resin by application of heat under pressure within said mold, said weight elements being of metallic material having a specific gravity equal to or greater than the specific gravity of iron.

15. A method as claimed in claim 14 in which said material rod is prepared by wholly wrapping a core made of a foamed resin with said envelope.

* * * * *